United States Patent [19]

Bower

[11] 3,983,913

[45] Oct. 5, 1976

[54] VAPOR RECOVERY AND VENT SIGNAL SYSTEM

[75] Inventor: Allen M. Bower, Conneaut, Ohio

[73] Assignee: Emco Wheaton Inc., Conneaut, Ohio

[22] Filed: June 3, 1975

[21] Appl. No.: 583,359

[52] U.S. Cl. ..... 141/95; 141/285

[51] Int. Cl.[2] ..... B65B 31/06

[58] Field of Search ..... 141/59, 285, 295, 298, 141/299, 346, 374, 392, 95; 285/131; 116/109, 112; 73/307, 291; 222/40; 137/557

[56] References Cited

UNITED STATES PATENTS

| | | | |
|---|---|---|---|
| 3,548,779 | 12/1970 | Green | 141/95 |
| 3,807,465 | 4/1974 | Ginsburgh et al. | 141/285 |

*Primary Examiner*—Houston S. Bell
*Attorney, Agent, or Firm*—Fetherstonhaugh & Co.

[57] ABSTRACT

In a liquid storage tank such as an underground storage tank for liquid fuels having a liquid input passage and a vent passage, the improvement of vapor recovery passage means opening outwardly from the tank and connectible to an external vapor recovery system, the vapor recovery passage being blocked by liquid flow when the level of liquid in the tank rises above a predetermined level to prevent the discharge of vapor therethrough, signal means communicating with the vent passage means and operative in response to an increase in pressure in the vent line caused by the blockage of the vapor recovery line during the filling of the tank to provide a signal indicating that the tank has been filled to a predetermined level.

9 Claims, 8 Drawing Figures

VAPOR RECOVERY AND VENT SIGNAL SYSTEM

FIELD OF INVENTION

This invention relates to liquid fuel storage tanks and improvements in systems for controlled filling of the tanks.

PRIOR ART

A difficulty which has long been encountered in filling liquid storage tanks such as underground fuel storage tanks of gasoline stations has been to prevent spillage resulting from the overflowing of the storage tank. Because of the very large number of underground storage tanks presently in existence, any system for preventing spillage must be readily adaptable for use in association with these existing installations with a minimum of modification being required.

It is important to ensure that an underground storage tank is not filled beyond capacity during the filling operation. Space must be provided above the liquid level to accommodate expansion of the liquid resulting from temperature variations and the like. In addition, space must be provided in the tank to permit draining of the conduits used to connect the filling tube of the underground storage tank to a tank truck after filling has been completed. Otherwise, the liquid in the filling conduit is generally spilled on the ground, where it often drains into basements, drains, water supplies and waterways. The danger of fire together with air and water pollution are obvious. Additionally, when gasoline is discovered underground an intensive investigation must be conducted to discover and eliminate the source. This often involves elaborate and expensive testing of underground tanks suspected of having leaks. Because leak testing often cannot indicate positively that a tank is not leaking, tanks are often replaced at great expense. In many such cases the tank was, in fact, not leaking, but rather the source was from spillages resulting from overfilling. Various systems have been developed which will inhibit the complete filling of a storage tank. These systems usually rely upon a pressure increase in the space above the liquid level of the tank to balance the pressure of the head of liquid discharging into the tank from the tank truck. When a balance is reached, the flow of liquid from the tank truck slows. In this system the operator does not have any signal indicating that the tank has been filled to required capacity other than the fact that the liquid flow is decreased. Generally the flow of liquid through the system is determined by visual examination of sight windows formed in one or other of the various conduits. Frequently, discolouration of the window or the nature of the liquid flowing through the conduit makes it difficult to visually discern the movement of the liquid past the window. Various devices such as rotary blades have been located in the systems in order to give a clear indication of liquid flow at the sight window. However, these devices are subject to failure which would indicate that no liquid is flowing when, in fact, a full flow condition may exist.

The present invention overcomes the difficulties described above with respect to the determination of the filling of the storage tank to the required level by providing a signal means for detecting an increase in pressure in a vent line which results from the level of liquid in the tank rising above a predetermined level.

The invention also overcomes the difficulties associated with the modification of existing systems to incorporate a signal system by providing a system which is simple to incorporate in existing underground storage tanks with a minimum of modification to the underground equipment.

The apparatus of the present invention is readily usable in association with vapour recovery systems which are designed to direct the vapours displaced from the underground storage tank to the vapour space in the compartment of the tank truck which is used for filling the underground storage tank.

In another aspect of the present invention, the signalling system which is activated in response to an increase in pressure in the vent line is connected to a control valve mechanism of the tank truck so as to close the control valve of the tank truck to stop the flow of liquid into the storage tank in response to the signal generated by the signalling device. This quickly prevents overfilling and spillage without requiring any reaction on the part of the operation.

According to one aspect of the present invention, there is provided in a liquid storage tank of the type having a liquid input passage opening into the tank and a vent passage opening outwardly from the tank, the improvement of; vapour recovery passage means opening outwardly from the tank and connectible to an external vapour recovery system for discharging vapour therethrough during the filling of the tank with liquid, the vapour recovery passage means being adapted to be closed when the level of liquid in the tank rises above a predetermined level to prevent the discharge of vapour therethrough, vent control means is provided in the vent passage operative to substantially restrict the vent passage, said vent passage means being operative to open the vent passage in response to a pressure increase above a first predetermined vent pressure and below a second predetermined vent pressure, signal means communicating with the vent passage means, said signal means being operative in response to an increase in pressure in the vent line caused by the blockage of the vapour recovery line during filling of the tank to provide a signal indicating that the tank has been filled to a predetermined level.

According to a further aspect of the present invention, there is provided a liquid loading system which comprises a liquid storage tank having a liquid input passage and primary and secondary vent passage means opening therefrom, a tank truck having at least one liquid transporting compartment, conduit means for connecting the liquid transporting compartment of the tank truck in fluid communication with the input passage of the storage tank, valve means mounted on the truck and communicating with the conduit means for regulating the flow of liquid through said conduit, valve control means communicating with said valve means for opening and closing the valve means, the primary passage means of the storage tank being adapted to close when the liquid level in the storage tank rises above a predetermined minimum level, signal means communicating with the secondary passage means, the signal means being operative in response to an increase in pressure in the secondary vent line caused by the blockage of the primary vent line to provide a signal indicating that the storage tank has been filled above a predetermined level and means connecting the signal means and the valve control means whereby the signal generated by the signal means operates the valve control means to close the valve means to interrupt the flow of liquid through the conduit.

It is, therefore, an object of the present invention to provide a signal means in the vent passage of a liquid storage tank operative to generate a signal in response to the level of liquid in the tank which is being filled reaching a predetermined level.

The invention will be more clearly understood after reference to the following detailed specification read in conjunction with the drawings wherein FIG. 1 is a diagrammatic illustration of a tank truck loading an underground storage tank;

Figure 1:
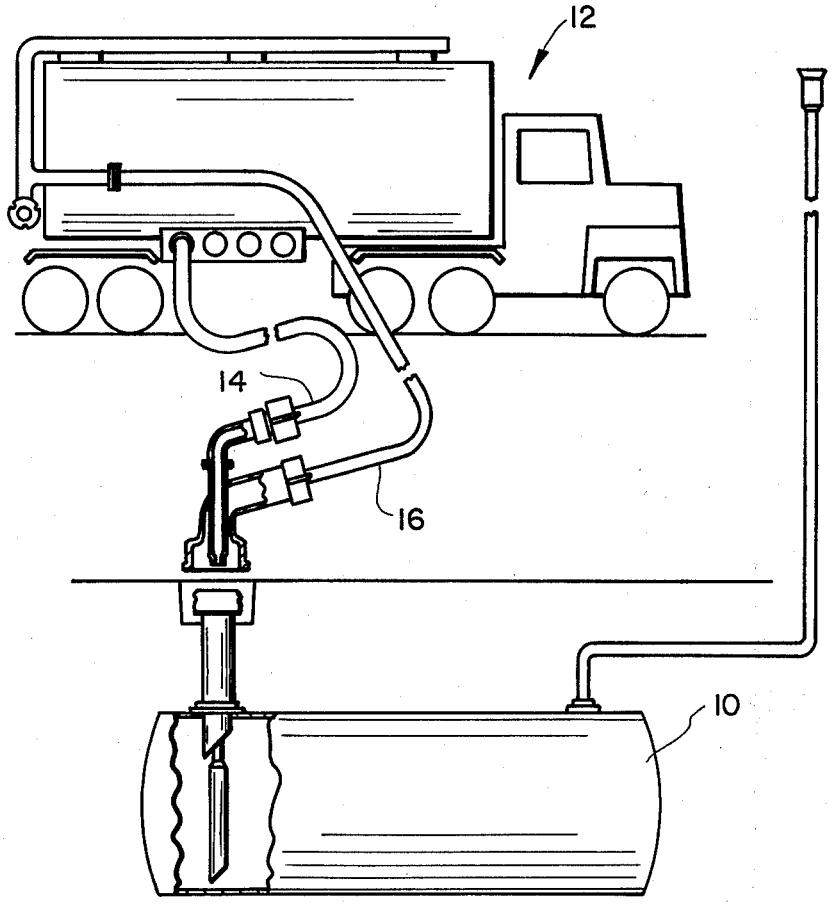

With reference to FIG. 1 of the drawings, the reference numeral 10 refers generally to an underground liquid fuel storage tank and the reference numeral 12 refers generally to a tank truck of the type used for delivering liquid fuel to underground storage tanks. The fuel outlet of the tank truck discharges fuel to the underground storage tank through a conduit 14 and vapour is expelled from the tank 10 during the loading and conveyed to the tank truck 12 by conduit 16.

Figure 2:
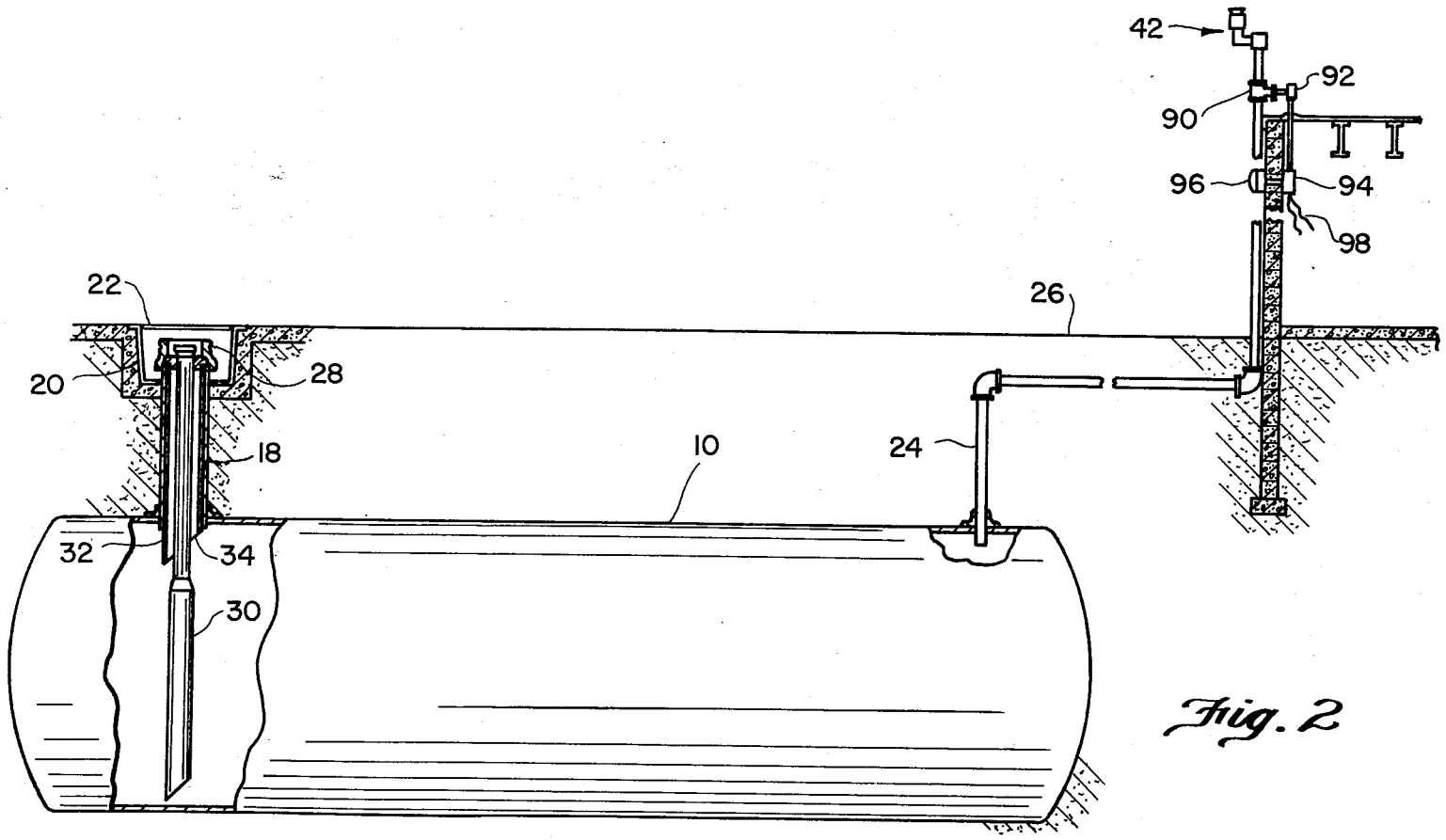
FIG. 2 is a diagrammatic view of an underground storage tank.

In FIG. 2 of the drawings, the underground storage tank 10 has a riser pipe 18 extending upwardly therefrom and has its upper end located in a well 20 which is closed by a manhole cover 22. A vent conduit 24 communicates with the interior of the tank 10 and extends upwardly to a substantial height above the ground level 26. It has long been the practice to provide underground storage tanks with a riser pipe 18 and a vent conduit 24 as illustrated in FIG. 2 of the drawings. The riser pipe has generally been used as a filling tube for filling the underground storage tank and the vent pipe 24 is located at sufficient height above the ground level to allow vapour to vent to and from the atmosphere.

With the introduction of vapour recovery systems, the use of a coaxial nozzle incorporating a filling tube and a vapour recovery line such as that described in U.S. Pat. No. 3,807,465 has become common. To accommodate this type of nozzle, an adaptor 28 is located at the upper end of the riser pipe 18. The adaptor 28 supports a filling tube 30 in a position extending downwardly therefrom. The gap formed between the riser pipe 18 and the filling tube 30 serves to provide a vapour recovery passage. The vapour recovery passage formed in this manner has its lower end at the upper wall of the storage tank.

Figure 3:
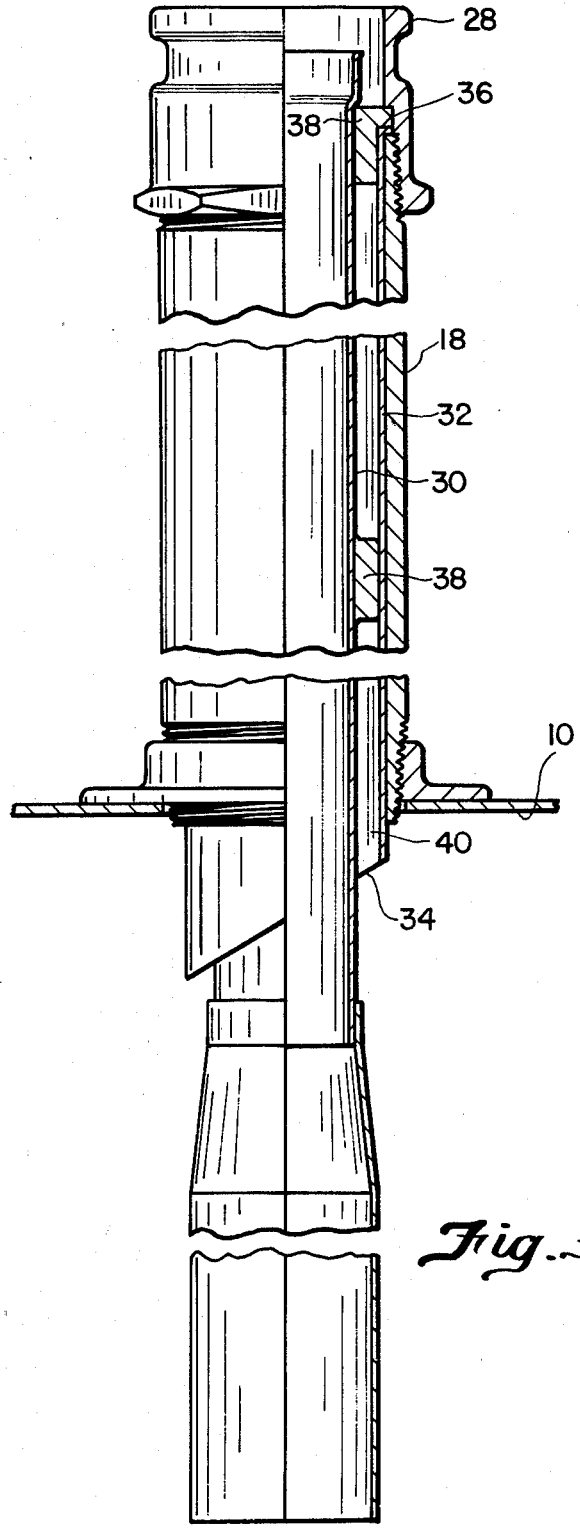
FIG. 3 is an enlarged view of the coaxial vapour recovery and filling tube of FIG. 2.

One of the features of the present invention is in the provision of a tubular sleeve 32 which is mounted at its upper end in the adaptor 28 which extends downwardly in a coaxial outwardly spaced relationship with respect to the filling tube 30 to a level below the upper surface of the tank 10. The lower end 34 of the filling tube is angularly inclined such that the level of liquid rising within the tank truck gradually cuts off the vapour recovery passage formed between the liner 32 and the filling tube 30. The vapour recovery passage will be completely cut off before the level of liquid in the tank rises to a level completely filling the tank. FIG. 3 of the drawings illustrates the manner in which the liner 32 and the filling tube 30 are located with respect to the filling tube 18. The liner 32 has a narrow flange 36 projecting radially from the upper end thereof. The tube 30 is maintained in a spaced relationship with respect to the liner 32 by means of a plurality of radial extending ribs 38 which project from the filling tube 30. The ribs 38 at the upper end of the filling tube 30 are provided with radially extending lugs which rest upon flange 36. The adaptor 28 is threadably mounted on the riser tube 18 and the lug portions of the ribs 38 and flange 36 are clamped between the adaptor 28 and the end of the riser tube 18. In this embodiment the vapour recovery passage 40 is formed between the liner 32 and the filling tube 30. The vapour recovery passage will remain open until the level of liquid rises above the lower end 34 of the liner 32. The liner 32 thereby provides an adaptor which serves to cut off the vapour recovery passage before the level of liquid has risen to a point sufficient to completely fill the storage tank.

Returning to a consideration of FIG. 2 of the drawings, it will be seen that when the vapour recovery passage 40 is closed a considerably greater volume of vapour will be vented through the vent line 24. The increase in volume of vapour discharging through the vent line 24 creates an increase in pressure in the vent line 24. This increases in pressure is built up by means of a vent control device 42 illustrated in FIG. 4 of the drawings. The vent control device 42 consists of a housing 44 which has an input passage 46 opening inwardly from one end thereof and an output passage 48 opening outwardly from the other end. A gland nut 50 is threadably mounted in the input passage 46 and compresses sealing ring 52 into engagement with the upper end of the vent line 24. Barrier walls 54 and 56 separate the input passage 46 from the output passage 48. An orifice 58 is formed in the barrier wall 54 and an orifice 60 is formed in the barrier wall 56. The upper surface of the orifices 58 and 60 are bevelled to form valve seats. Valve members 62 and 64 are mounted in the valve seats of the orifices 58 and 60 respectively. The valve members 62 and 64 have guiding lugs 66 and 68 slidably mounted in the orifices 58 and 60. The valve member 62 has a column 70 projecting upwardly therefrom which is formed with internal passage 72. The valve member 64 has a stem 74 projecting downwardly therefrom and slidable within the passage 72 formed in the valve 62. The vent line 24 is normally closed by the valves 62 and 64 which will remain closed until the pressure in the vent line 24 increases above a predetermined minimum pressure required to open the valve 62. It will be noted that the valve 62 will be raised from the seat in which it is mounted when the pressure in the line 24 exceeds a predetermined pressure. In elevating from its lowered position, the valve 62 will be maintained in an aligned position with respect to the orifice 58 by the relationship between the stem 74 and the column 70. When the pressure in the vent line 24 falls below a minimum pressure, such as in the case where the contents of the tank contract due to temperature variations, the valve member 64 will open upwardly to permit air to enter the vent line 24 by way of the orifice 60. A suitable hood 80 is located at the discharge end of the output passage 48 to prevent undesirable contamination.

Figure 4:
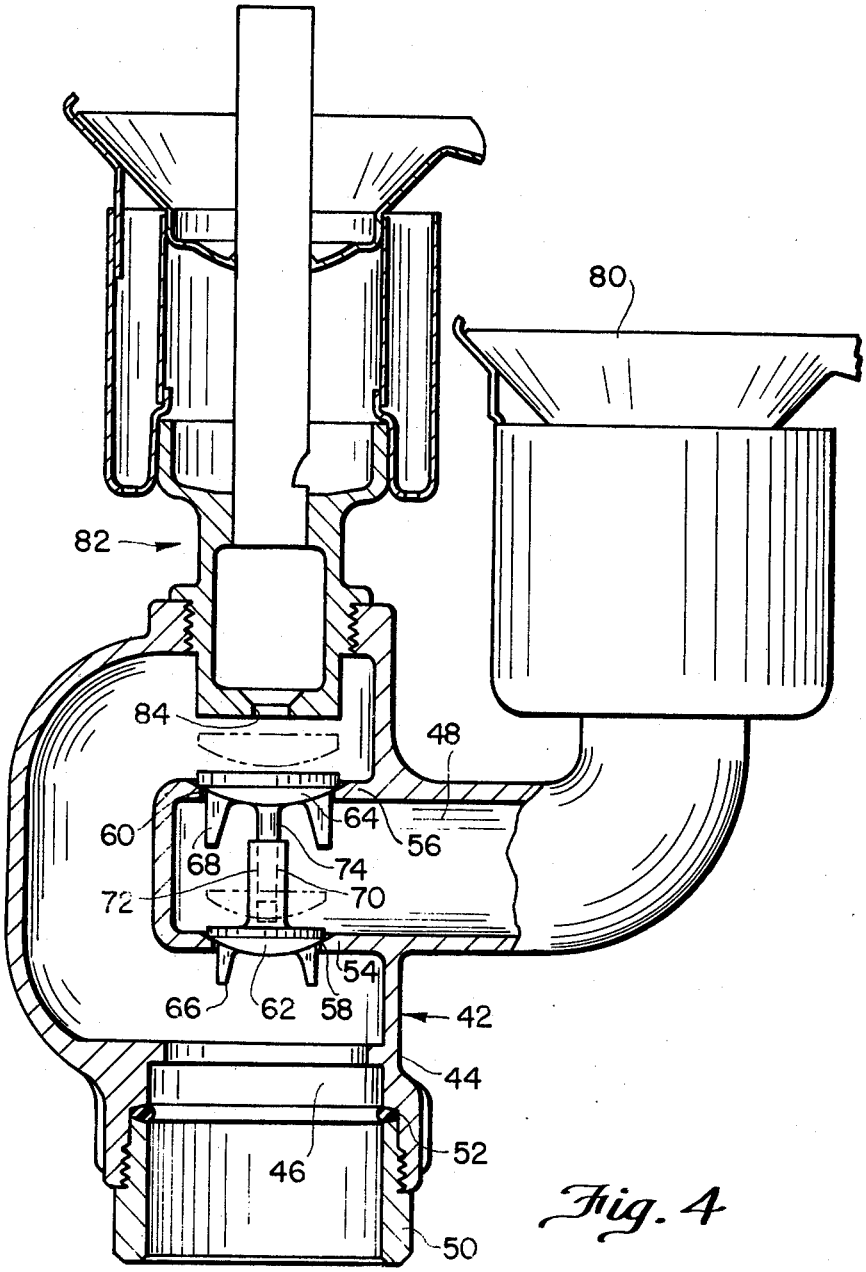
FIG. 4 is an enlarged partially sectional view of the vent control means incorporating a whistle and pressure vacuum vent according to an embodiment of the present invention.

In the embodiment illustrated in FIG. 4 of the drawings, a signalling device in the form of a whistle 82 is mounted on the housing 42 and has an input passage 84 opening outwardly from the passage 46, The diameter of the input passage 84 of the whistle is sufficiently small to provide the free escape of any amount of vapour which would prevent an accumulation of vapour in the vent line 24 when the vapour recovery line is closed. The passage 84 is, however, sufficiently large to ensure that a sufficient volume of air will pass to the whistle to provide a loud, audible signal. The whistle 82 is of a conventional construction including a suitable enclosure for preventing contamination or obstruction of the various whistle passages.

An alternative form of alarm is provided by the structure illustrated in FIG. 2 of the drawings wherein a T-connection 90 is located in the vent line 24. A pressure-sensitive switch 92 is connected to the vent line 24 by a conduit connected to one of the arms of the T-connection 90. The pressure-sensitive switch may be of a well known type such as a diaphragm line pressure switch, available from Barksdale Corporation, a division of De Laval Turbine Company Inc. The pressure-sensitive switch is electrically connected to a relay 94. The relay 94 may be an intrinsically safe relay such as a GEMS SAFE-PAK Relay No. 451862 or No. 451863 manufactured by Gems Company Inc., a division of De Laval Turbine Company Inc. The relay 94 serves to activate an alarm bell 96 in a well known manner by connecting the alarm bell 96 to a main power supply by means of conducters 98. The alarm bell 96 provides an audible signal which is indicative of the same increase in pressure in the vent line 24 which activates the whistle 82 of the embodiment previously described.

Figure 5:
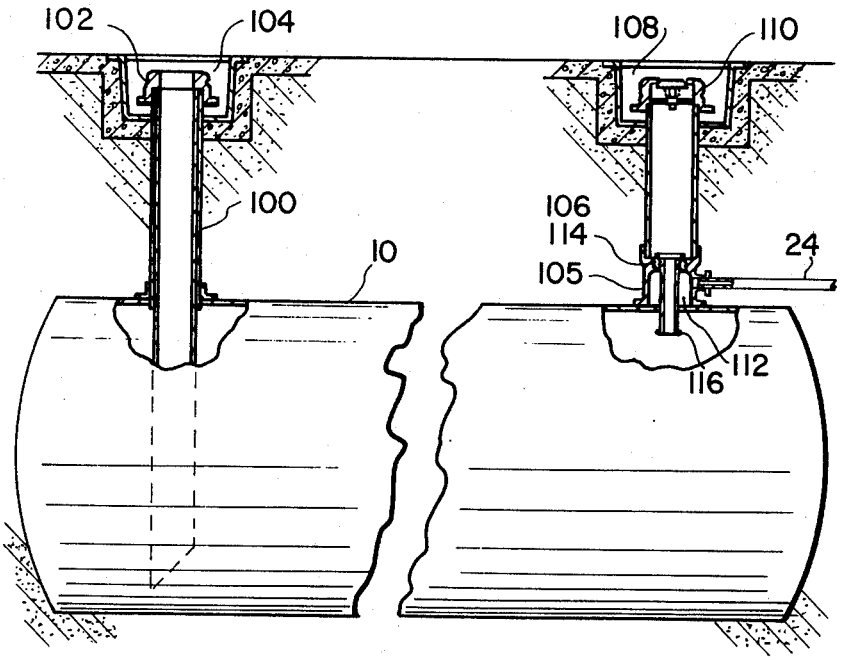
FIG. 5 is a view similar to FIG. 2 illustrating an alternative structure for adapting an existing underground storage tank according to an embodiment of the present invention.

Various modifications of the present invention will be apparent without departing from the scope of the invention. A further embodiment of the present invention is illustrated in FIG. 5 of the drawings. The apparatus illustrated in FIG. 5 of the drawings may be connected to a signal device such as the whistle vent or the alarm bell described above by means of the vent line 24. In the embodiment illustrated in FIG. 5 of the drawings, like numerals are applied to like parts previously indicated in the drawings described above. In the apparatus illustrated in FIG. 5, the underground storage tank has a filling tube 100 opening inwardly thereof at one end of the tank. The filling tube has an adaptor 102 at the upper end thereof located in a well 104. This type of filling tube is in wide use today in existing installations together with a conventional vent line which is connected to the tank in the manner illustrated in FIG. 2 above. These existing installations can be modified to provide the alarm signal previously described by excavating in the area of the vent line 24 and installing an extractor fitting 105 and a riser pipe 106 extending upwardly therefrom into a well 108. An end adaptor 110 is mounted at the upper end of the riser pipe 106. The extractor fitting 105 has an input passage 112 opening into a central chamber located therein. The vent pipe 24 is connected to the fitting 105 and opens into the chamber formed within the fitting 105 so that the atmosphere within the tank may be vented through the fitting 105 by way of input passage 112 and vent line 24. The upper end of the fitting 105 is closed by annular ring 114 which forms a barrier wall between the chamber which is located within the fitting 104 and the interior of the riser pipe 106. A drop tube 116 is mounted in the barrier wall 114 and projects downwardly therefrom into the tank 10. The drop tube 116 has a passage 118 extending therethrough. The passage 118 extends between the interior of the riser tube 106 and the interior of the tank 10. The lower end of the drop tube 116 is located a substantial distance below the upper end of the tank 10. When this apparatus is in use in association with the vapour recovery system of a tank truck, the vapour recovery coupler of the tank truck is mounted on the adaptor 110 in a well known manner so that during the filling operation the vapour recovery vapours are discharged through the passage 118 in the drop tube 116 through the riser pipe 106 to discharge from the riser pipe 106 into the vapour recovery system of the tank truck. Again, the rising of the liquid in the underground storage tank closes the end of the drop tube 116 at a predetermined level causing all of the venting vapours to discharge through vent line 24 to activate the alarm system as previously described.

Figure 6:
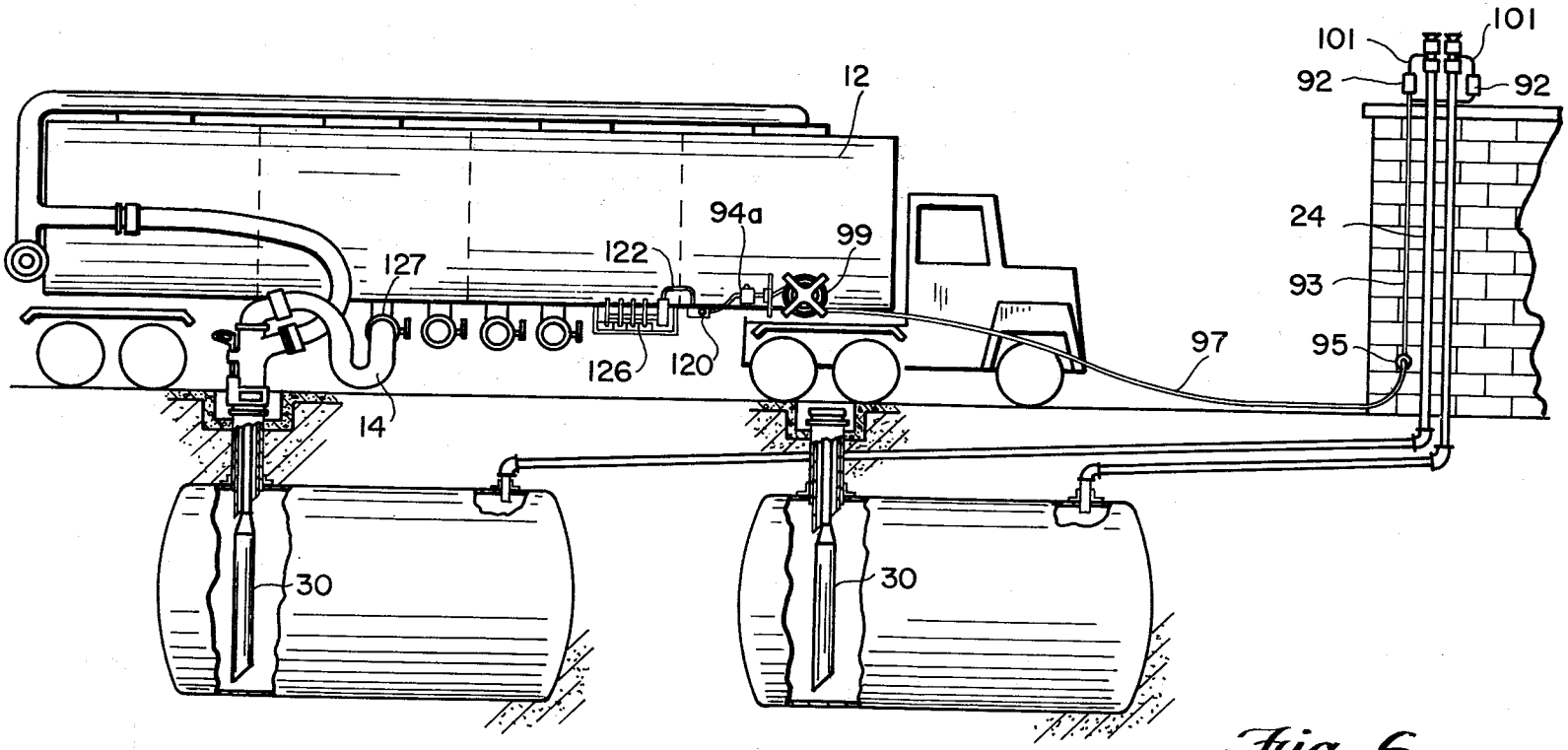
FIG. 6 is a diagrammatic illustration of the manner in which the control valve of the tank truck is connected to the signal system of the storage tank so that the emergency valve may be closed by the signalling means when the level of liquid in the tank reaches a predetermined level.

FIG. 6 of the drawings illustrates a further embodiment of the invention wherein the N.C. pressure switch 92 is electrically connected by means on a conductor 93 to a socket 95 mounted on a switch fixture such as the wall of a building. An electrical cable 97 is mounted on a reel 99 on the truck 12 and may be unwound for connection with the socket 95. The other end of this cable 97 is connected to the intrinsically safe relay **94*a* which is also mounted on the truck 12. The relay 94*a* is arranged to connect the 12v electrical supply of the truck to an air supply valve 120. The three-way valve 120 is located in the air passage line 122 which connects the air braking system of the truck to the emergency valve control device 126. A signal from the signalling device relay 92 activates relay 94*a* which in turn operates the valve 120 to close the valve 120 and thereby cut off the air supplied by way of pressure line 122 when the pressure in the vent line 24 rises above the predetermined minimum pressure as previously described. With this apparatus, the flow of liquid from the emergency valves 127 to the filling tube 30** is halted when the level of liquid in the tank rises above a predetermined level as previously described.

Figure 7:
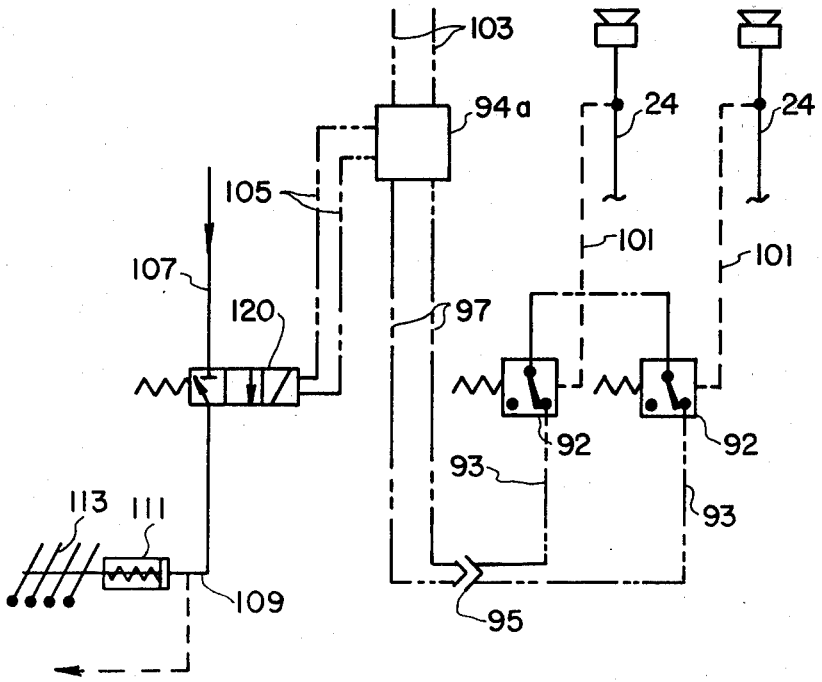
FIG. 7 is a schematic illustration of an air and electrical circuit used to effect the control of the emergency valve in response to a signal from the signal device.

FIG. 7 of the drawings schematically illustrates the circuit described in FIG. 6. An increase in air pressure in either of the vent lines **24*a* is transmitted to normally closed pressure switches 92 by way of conduits 101. The switches 92 are electrically connected to socket 95 by lines 93. The intrinsically safe relay 94*a*, which as previously mentioned is mounted on the truck, is connectible to socket 95 by lines 97. The relay 94*a* is connected to the 12 volt supply of the tank truck by means of lines 103 and to a three-way solenoid operated valve 120 by way of lines 105. The three-way valve 120 is connected to the air supply of the truck 12 by way of air lines 107. The three-way valve 120 is connected by way of line 109 to a release cylinder 111 which, in turn, is connected to the lever arms 113 which are used to control the opening and closing of the emergency valve 127. Alternatively, the three-way valve 120 may be connected directly to air operated emergency valve 127. In use, the emergency valves cannot be opened until the line 97 carried by the tank truck is connected at the socket 95 to the relays 92. When this connection is made, the intrinsically safe relay 94***a* moves the three-way valve to the position connecting the air supply line 107 to the line 109. In this position air is supplied to permit operation of the air operated emergency valves as required. When the pressure in the vent lines 24 increase above a predetermined pressure, one of the pressure sensitive switches 92 will be activated which, in turn, activates the relay 94*a* to return the three-way valve 120 to the exhaust position shown in FIG. 7, thereby venting the air line 109 to render the emergency valves inoperative and thereby close the emergency valves. The emergency valves may be rendered inoperative by the operation of the release cylinder 111 to move the lever arms 113 to the closed position. Alternatively, the direct supply of air to the air operated emergency valves may be interrupted causing the air emergency valves to be closed.

From the foregoing it will be apparent that the operator cannot fill an underground storage tank without first connecting the truck to the automatic cut-off system or alarm system. Furthermore, if the connection between the truck and the alarm system is broken or disconnected or if the power supply fails for any reason, all of the emergency valves of the truck will be closed. In addition, if the operator cannot otherwise determine which tank is approaching overfill, he merely restarts the filling of one tank. If the emergency valve again closes, he is then alerted as to which tank is almost full. This characteristic is of importance in installations where more than one underground storage tank is being filled at the same time.

Figure 8:
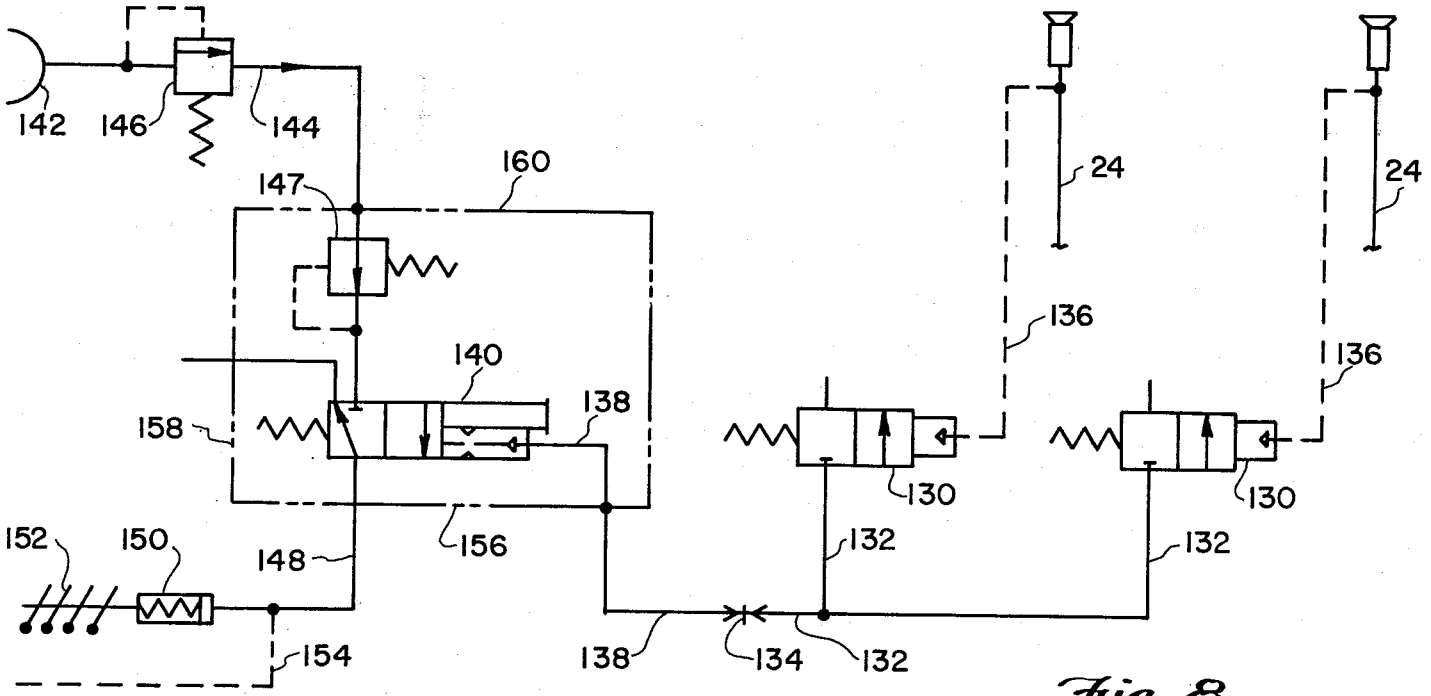
FIG. 8 is a schematic illustration of a totally pneumatic control circuit.

FIG. 8 of the drawings illustrates an air circuit which functions in a manner similar to the electrical circuit illustrated in FIG. 7 of the drawings. In this embodiment, the vent lines 24 are connected by conduits 136 to normally closed two-way exhaust valve 130. The valve 130 are connected to a quick connector device 134 by means of conduits 132. The quick connector device 134 may be mounted on the wall of the installation in a manner similar to that in which the electrical socket 95 is mounted as illustrated in FIG. 6 of the drawings. A conduit 138 in the form of a rubber hose or the like is connectible to the quick connector 134 at one end and at the other end it is connected to a normally closed three-way air supply valve of the type having a manual set. Air from the air tank 142 of the vehicle is connected by means of a conduit 144 to the three-way valve 140. Pressure protection valves 146 and 148 are provided in the line 144. Conduit 148 connects the three-way valve 140 to a release cylinder 150 which is in turn connected to the emergency valve operator handles 152. Alternatively, air may be supplied directly to the air operated emergency valves by means of a conduit 154. The conduit 138 is connected to the conduit 140 by means of a feed-back conduit 156. The conduit 144 is connected to the conduit 148 by means of a by-pass conduit 148 and the conduit 138 is connected to the conduit 144 by means of a further by-pass conduit 160.

In use, the operator connects the conduit 138 which is carried by the vehicle to the conduit 132 by means of the quick connector 134. The operator then manually sets the three-way valve 140 to the open position, thereby closing the exhaust port and directing the air supply from the air tank 142 to the release cylinder 150. The three-way valve 140 is maintained in the closed position by the pressure in the line 138. In this position, the release cylinder 150 is activated to release the emergency valve operating mechanisms so that they may be operated independently of one another. When the pressure in either of the lines 24 exceeds a predetermined minimum pressure, the two-way exhaust valves 130 are activated to move to the exhaust position. As a result, there is a pressure drop in the line 132 and lines 138. This pressure drop releases the three-way valve 140, causing it to return to the exhaust position so that the line 148 is connected to the exhaust port of the three-way valve. The drop in pressure in the line 148 causes the release cylinder 150 to move to a position rendering the emergency valve mechanisms inoperative. Again, this circuit provides a direct connection between the liquid filling mechanism of the vehicle and the vent system of the underground storage tank so that the supply of liquid to the storage tank is automatically cut off when the level of liquid in the tank rises to a predetermined level.

From the foregoing it will be apparent that the present invention provides a signal to the operator or a signal to an automatic control mechanism which will ensure that the filling of the tank may be interrupted before the tank has been completely filled. In this manner, an adequate space remains in the tank to permit the operator to drain the conduits leading to the tank after the emergency valve of the tank truck has been closed. The signal as previously indicated may be in the form of an alarm bell or a whistle associated with the vent passage or it may take the form of a signal to a control valve on the tank truck for interrupting the flow of liquid discharging from the tank truck. As indicated by the preferred embodiments described above, the system is adaptable for use in association with systems which incorporate a vapour recovery system or systems which operate without a vapour recovery system. Furthermore, the structure is such that existing underground storage tanks may be easily modified for use in association with the alarm system.

Various modifications of the present invention will be apparent to those skilled in the art. For example, the flow of vapour through the vapour recovery line such as the extension tube 116 in FIG. 5 of the drawings may be interrupted by means of a ball float which is floated upwardly into engagement with the lower end of the extension tube 116 as the level of liquid rises in the tank. These and other modifications will be apparent to those skilled in the art.

What I claim as my invention is:

1. In a liquid storage tank of the type having a liquid input passage opening into the tank and a vent passage opening outwardly from the tank, the improvement of:

a. vapour recovery passage means opening outwardly from said tank and connectible to an external vapour recovery system for discharging vapour therethrough during the filling of the tank with liquid, said vapour recovery passage means being adapted to be blocked by liquid flow to prevent the discharge of vapour therethrough when the level of liquid in the tank rises above a predetermined level which is below the level at which the tank is full whereby the further venting of the tank required to permit continued filling of the tank will be by way of said vent passage, b. signal means communicating with said vent passage means, said signal means being operative in response to an increase in pressure in said vent line caused by the continued flow of liquid into the tank after blockage of said vapour recovery line during filling of the tank to provide a signal indicating that the tank has been filled to a predetermined level.

2. A liquid storage tank as claimed in claim 1 including vent control means in said vent passage operative to substantially restrict the vent passage, said vent control means being operative to open with said vent passage in response to a pressure increase above a first predetermined vent pressure and a pressure decrease below a second predetermined vent pressure.

3. In a liquid storage tank as claimed in claim 1 wherein said liquid passage means has a coaxial vapour recovery and liquid filling adaptor at the upper end thereof supporting a liquid filling tube which extends downwardly into the tank, the improvement of a. a tubular liner member having an upper end and a lower end, said tubular liner member being disposed coaxially outwardly from said filling tube and having its upper end mounted is said adaptor to define a vapour recovery passage between the liner and the filling tube opening upwardly through the adaptor, the lower end of said tube projecting downwardly into said tank and terminating above the lower end of the filling tube at a level below the full height of the tank whereby a rising liquid level in the tank will block the vapour recovery passage as aforesaid at a predetermined level.

4. A liquid storage tank as claimed in claim 1 wherein said vapour recovery passage means comprises, a. a vapour riser pipe extending upwardly from the tank, said riser pipe having one end mounted on the tank and a vapour recovery adaptor at the other end thereof, a divider member mounted within said riser dividing the interior thereof into an upper chamber and a lower chamber, secondary passage means opening through said divider member for placing said upper chamber in fluid communication with said tank, said secondary passage means being adapted to be blocked when the level of liquid in the tank rises above said predetermined level to effect blockage of said vapour recovery passage means, said vent passage means being connected to said lower chamber such that said vent passage means remains in communication with said tank when said vapour recovery passage means is blocked.

5. A liquid storage tank as claimed in claim 2 wherein said vent control means comprises a housing having one end connectible to said vent passage of said tank, an input passage opening into said housing and first and second pressure relief passages opening outwardly from said housing, first passage closure means normally closing said first pressure relief passage, said first passage closure means being operative to open said first passage when the pressure in the vent line rises above said predetermined maximum pressure, second passage closure means normally closing said second pressure relief passage, said second passage closure means being operable to open said second passage means when the pressure in said vent line falls below said predetermined minimum pressure.

6. A liquid storage tank as claimed in claim 1 wherein said signal means is in the form of a whistle having an input passage communicating with said vent passage, said whistle being proportioned to provide an audible signal when the pressure in the vent line approaches the predetermined maximum pressure.

7. A liquid storage tank as claimed in claim 1 wherein said signal means comprises pressure sensitive switch means communicating with said vent passage means, relay means operatively connected to said pressure switch means and alarm bell means operatively connected to said relay means, said pressure sensitive switch means being operative in response to an increase in pressure in said vent line during the filling of the tank to activate the relay means which in turn activates the alarm bell means to provide an audible signal.

8. In a liquid storage tank having a liquid input passage and a standard vent passage, the improvement of a. a further vent passage opening from said storage tank, said further vent passage being adapted to be blocked by liquid flow when the level of liquid in the tank rises above a predetermined level, which is below the level at which the tank is full, to prevent the discharge of vapour therethrough, b. signal means communicating with said standard vent passage, said signal means being operative in response to an increase in pressure in said standard vent passage caused by the blockage of said further vent passage to provide a signal indicating that the storage tank has been filled to a predetermined level.

9. A liquid loading system comprising a. a liquid storage tank having a liquid input passage and primary and secondary vent passage means opening therefrom, b. a tank truck having at least one liquid transporting compartment, c. conduit means for connecting said liquid transporting compartment of said truck in fluid communication with said input passage of said storage tank, d. valve means mounted on said truck and communicating with said conduit means for regulating the flow of liquid through said conduit, e. valve control means mounted on said truck and communicating with said valve means for opening and closing said valve means, f. said primary vent passage means of said storage tank being adapted to be blocked by liquid flow when the level of liquid in the storage tank rises above a predetermined minimum level which is lower than the level at which the tank is full, g. signal means communicating with said secondary passage means, said signal means being operative in response to an increase in pressure in said secondary vent line caused by the blockage of the primary vent line to provide a signal indicating that the storage tank has been filed to a predetermined level, h. means connecting said signal means and said valve control means whereby the signal generated by said signal means operates said valve control means to close said valve means to interrupt the flow of liquid through said conduit when the level of liquid rises above said predetermined level.

* * * * *